United States Patent [19]

Callegari, Sr.

[11] Patent Number: 4,733,723

[45] Date of Patent: Mar. 29, 1988

[54] GRAVEL PACK ASSEMBLY

[76] Inventor: Stephen R. Callegari, Sr., 419 Orangewood Dr., Lafayette, La. 70503

[21] Appl. No.: 71,983

[22] Filed: Jul. 10, 1987

Related U.S. Application Data

[63] Continuation of Ser. No. 886,731, Jul. 18, 1986, abandoned.

[51] Int. Cl.[4] ..... E21B 43/04; E21B 34/06; E21B 34/12

[52] U.S. Cl. ..... 166/51; 166/278; 166/318

[58] Field of Search ..... 166/51, 278, 318

[56] References Cited

U.S. PATENT DOCUMENTS

| | | | |
|---|---|---|---|
| 2,409,811 | 10/1946 | Taylor, Jr. . | |
| 3,913,676 | 10/1975 | Barbee, Jr. et al. | 166/278 |
| 3,963,076 | 6/1976 | Winslow | 166/278 |
| 4,018,284 | 4/1977 | Perkins | 166/278 |
| 4,175,778 | 11/1979 | Nunez et al. | 166/125 X |
| 4,296,807 | 10/1981 | Hendrickson et al. | 166/184 |
| 4,570,714 | 2/1986 | Turner et al. | 166/51 X |

FOREIGN PATENT DOCUMENTS

| | | | |
|---|---|---|---|
| 2066326 | 12/1979 | United Kingdom | 166/278 |

*Primary Examiner*—George A. Suchfield
*Attorney, Agent, or Firm*—John D. Jeter

[57] ABSTRACT

A well apparatus connected to a pipe string extending down into a cased borehole for treating a formation comprising a packer assembly for sealing with the casing assembly and an integral crossover/release assembly attached to the packer assembly, and closing a channel between the tubing bore and the lower extremity of the gravel screen before or after treating the formation. Before releasing the screen, a channel exists between the tubing bore and a projecting wash pipe extending below the gravel screen. Releasing the screen closes the lower screen penetrating channel.

21 Claims, 11 Drawing Figures

GRAVEL PACK ASSEMBLY

This is a continuation of application Ser. No. 886,731, filed 7-18-86, now abandoned.

FIELD OF UTILIZATION

The present invention relates generally to the field of well completion and more particularly to sand control in wells. Specifically, this invention relates to placement of gravel pack screens and their release with flow controls peculiar to such operations manageable by manipulation of the working pipe string and control of flow of fluids moving therethrough.

BACKGROUND OF THE ART

The flow of sand into producing oil and gas wells from the producing formations is well known. The best current sand control practice involves placement of gravel screens in the well in the vicinity of the production zone and packing gravel around the screen and into the formation openings to retard the entrainment of sand by fluids migrating to the well bore.

Gravel packing is usually done by the crossover method. The crossover method involves lowering a gravel screen below a crossover device and a packer to the payzone area on a working pipe string. The packer is closed against the well bore wall, and the gravel (usually in a viscous carrier fluid, or slurry) is pumped down the work string flow bore and dumped in the well annulus outside the screen below the packer. The carrier fluid is allowed to return through the screen into a stinger washpipe extending into the screen interior, back to the crossover means, where it is directed into the well bore above the packer.

Hardware has evolved that allows the work string to control the packer, crossover device, and release the screen from the work string, so that the screen is left in the well, and most other hardware is recovered with the work string.

Advantages of the crossover system includes confinement and control of the downflowing gravel slurry within the work string to prevent contamination of the upper well bore with gravel and debris dislodged by gravel.

When packers and gravel screen release contrivances are both used on one work string, the manner of setting the packer and releasing the screen should be separate, so that packer manipulations do not also release the screen. By using work string rotation and weight to set the packer and hydraulic pressure to release the screen, several operations can be carried out in one trip into the well with the work string. Flow through the work string is essential to several well-conditioning operations, and it is desirable to flow without releasing the screen. It is common practice to drop an object down the work string bore to prepare downhole machine elements to release screens on the next occurrence of forward circulation through the work string bore.

Prior art in releasing tools downhole without rotating the work string is typified by U.S. Pats. Nos. 2,409,811 and 4,175,778; the latter being specific for gravel packing and the former being more general in nature.

The screen release apparatus most closely related to the present invention is disclosed in U.S. Pat. No. 4,570,714. In terms of net effect, the present invention distinguishes in providing a forward or reverse circulation flow through channel to the very bottom of the screen assembly in communication with the work string flow bore prior to screen release and the ability to close the lower screen penetrating channel on screen release. The feature permits apparatus of the present invention to be used as if it were only a work string with a packer to reverse out sand and other materials without compromising the screens. Additionally, the present invention permits clean fluid to be used to backflush screens if they become plugged in well treating. Such actions are not possible with apparatus of the U.S. Pat. No. 4,570,714. It is quite possible to avoid one work string trip into the well with apparatus of the present invention.

OBJECTS OF THE INVENTION

Therefore, it is an object of this invention to provide well treating apparatus that permits full length forward and reverse circulation of fluid through a work string and gravel pack screen assembly prior to screen release.

It is another object of this invention to provide apparatus to close off the lower extremity flow bore penetration of the gravel screen assembly when the screen assembly is released from the work string.

It is yet another object of this invention to provide well treating crossover control apparatus that has no crossover channels until crossover is actuated.

It is still another object of this invention to provide a circulation valve to control fluid flow between the interior of the released screen and the well annulus above a set packer integral with the packer manipulation equipment.

It is yet another object of this invention to provide apparatus to operate either the packer or the circulation valve by choice of sequence and nature of axial and rotational manipulation of the work string.

It is yet another object of this invention to provide a hydraulically actuated crossover valve for a well treating gravel packing system that simultaneously releases a gravel screen with crossover valve actuation.

It is still a further object of this invention to provide well treating apparatus that releases gravel pack screen assemblies and permits recovery of the reusable packer controls, crossover valve, and screen release assemby as well as the screen stinger.

It is yet another object of this invention to provide methods to clean up a well bore, gravel pack, squeeze, circulate out fines, and recover all downhole hardware not essential to the gravel screen assembly, in one trip.

It is still a further object of this invention to provide apparatus to permit elected closure and pressure testing of a foot valve below a screen assembly before the screen is released.

These and other objects, advantages, and features of this invention will be apparent to those skilled in the art from a consideration of this specification, including the attached drawings and appended claims.

SUMMARY OF THE INVENTION

The method and apparatus of the present invention involves a working pipe string extending from the earth surface down a cased borehole to a payzone region, and a formation treating assembly attached to the work string.

The suspended treating assembly includes a conventional packer, a conventional gravel screen assembly, and a novel manipulation apparatus.

The novel manipulation apparatus provides means under all conditions to actuate the packer and to carry out a configuration change in the fluid channeling.

As the apparatus is installed in the well, the fluid channel of the work string continues through packer and gravel screen stinger, to be ejected below the screen assembly. Forward and reverse circulation can be conducted, and the packer can be closed, after which the formation can be squeezed without pressuring the upwardly continuing well annulus.

To change downhole configuration, a plug is dropped down the work string bore to land on and occlude a piston exposed to the work string bore pressure. Pressure applied to the work string bore causes the piston to affect:

(1) plug the downwardly continuing fluid channel from the work string bore, where it once joined a stinger flow bore that extended below the screen assembly;

(2) detach the screen assembly from the work string, allowing the screen the drop down, sealingly sliding down the stinger;

(3) pull the open lower end of the washpipe into the screen assembly.

(4) closes the once open lower flow channel that once extended from the washpipe out the lower end of the screen assembly.

(5) opens crossover valves that connect the upwardly continuing work string flow bore to the well annulus below the packer and connects the stinger flow bore, by way of confining fluid flow galleries, to a valve between the work string and the packer, which opens to the well annulus above the packer.

Once the downhole configuration is changed, the valve between the packer and work string controls pressure and flow communication between the upper well annulus and the stinger flow bore opening inside the lower portion of the released screen assembly.

Before configuration change, the assembly can be used, by reverse circulation as appropriate, to clean out a well, acidize, and squeeze. After configuration change, with packer set, gravel pack can be provided down the work string flow bore with carrier fluids being returned through the screen.

After gravel packing is complete, the work string, packer, crossover-release assembly, and stinger are recovered from the well bore, leaving the gravel screen assembly downhole.

BRIEF DESCRIPTION OF DRAWINGS

In the drawings, wherein like reference characters are used throughout to designate like parts.

DETAILED DESCRIPTION OF DRAWINGS

Tools used in well bores are necessarily of small diameter, and in most cases the tool structures are quite slender. Small scale drawings of such tools can be more clearly presented if the diametral dimension is shown enlarged relative to length, and the present drawings are distorted in scale for clarity. Additionally, manufacturing and maintenance considerations frequently result in several elements being fastened together to form one functional structure. Where such complicating details have no bearing on points of novelty, the functional structure may be shown as one part. Further, those surfaces situated for relative motion with fluid sealing integrity are captioned by the letter S rather than attempting to define a seal shape in the sealed region. The steps taken to simplify drawings to improve drawing and descriptive clarity are justified on grounds that those skilled in the art disclosed are inherently skilled in the fundamentals of machine constuction art as well.

An overall functional description will be followed by more specific details.

Figure 1A:
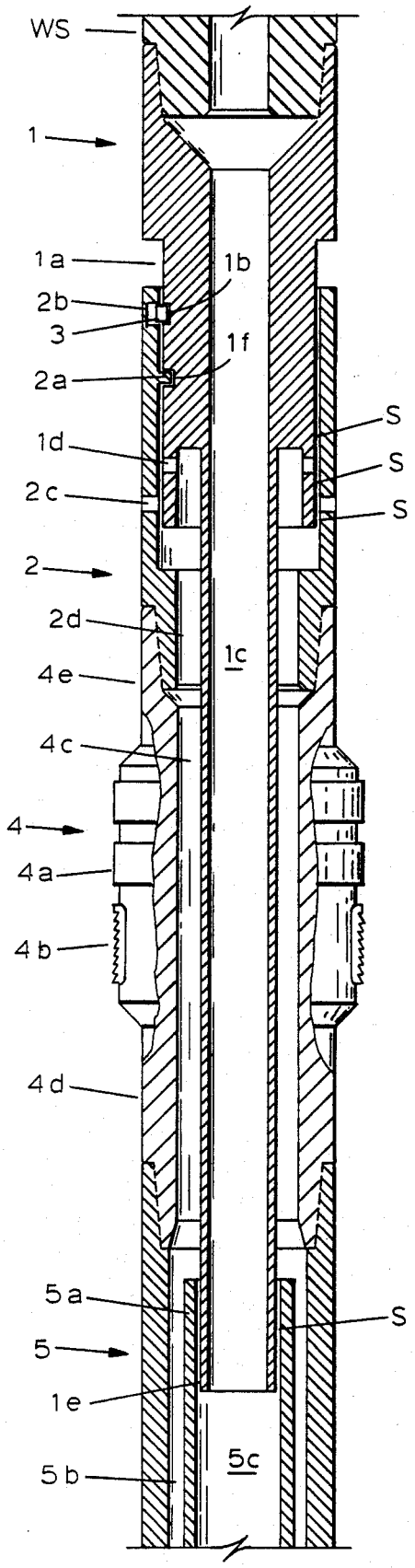
FIGS. 1A and 1B are side views, mostly in cutaway, of the preferred embodiment of the invention in the before activation and after activation configurations.
Figure 1B:
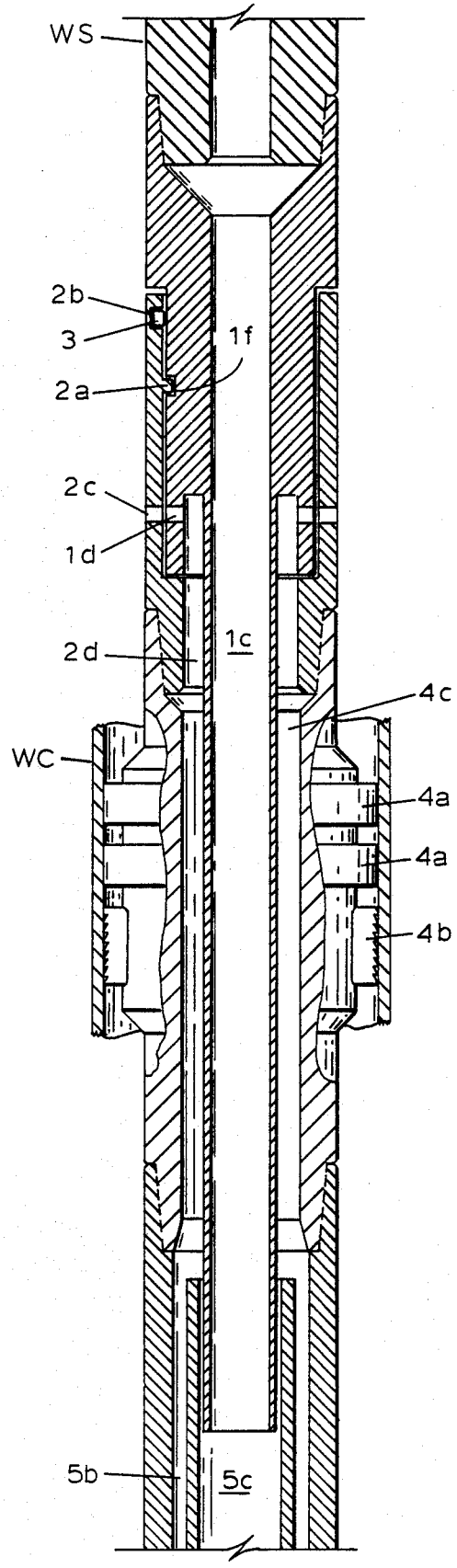
Figure 2A:
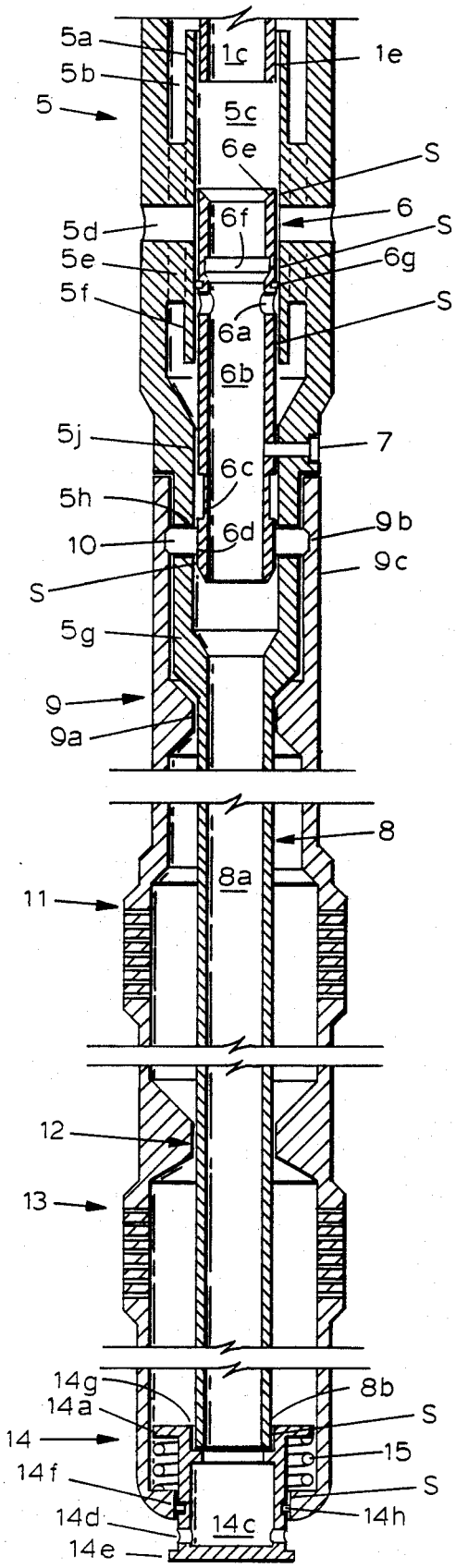
FIGS. 2A and 2B are downward continuations of FIGS. 1A and 1B respectfully.
Figure 2B:
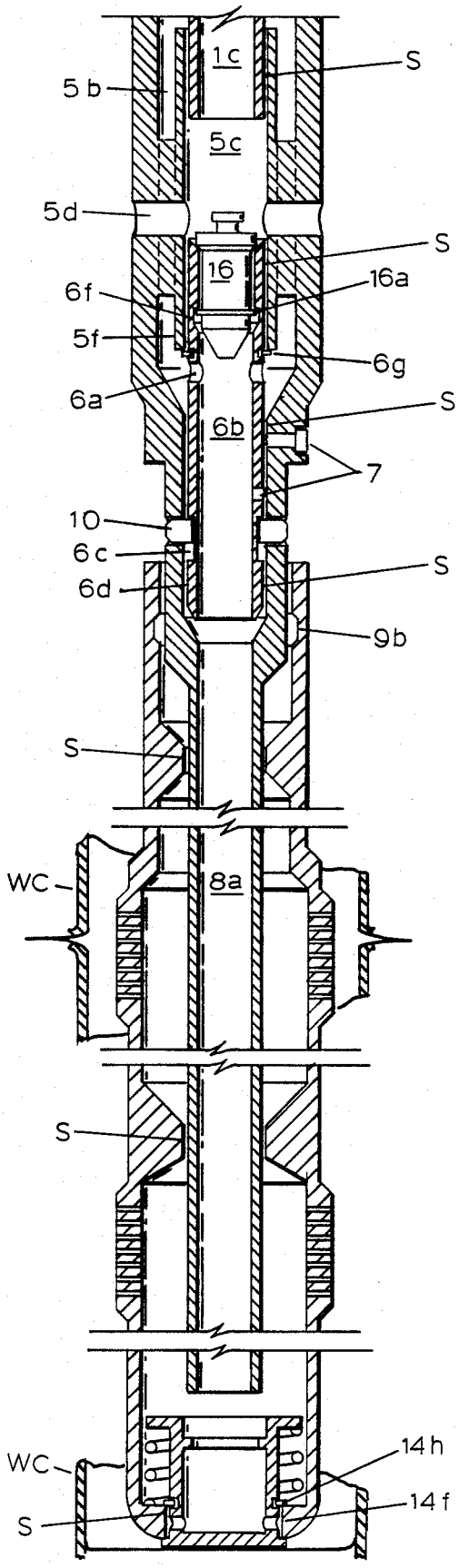

FIGS. 1A and 2A are mutually continuing drawings, and FIGS. 1B and 2B represent the same apparatus after actuation in a well bore. FIGS. 1A and 2B show apparatus in the runin configuration for the trip into a well bore, but the apparatus can be used as shown for forward or reverse circulation to clean out a well bore. Additionally, packer 4 can be actuated to carry out some activity.

Manipulator arbor 1 and circulating housing 2 form a circulating valve assembly attached to an upwardly continuing work string WS and to a conventional packer 4. Crossover-release 5 is attached to the packer and is releasably attached to a mating screen nipple 9. Screen nipple 9 is attached to a conventional gravel screen assembly 11 and 13. A blank pipe is usually situated between nipple 9 and screen 11. An O-ring sub 12 is usually used between screens 11 and 13.

Foot valve 14 is unique and provides the lower terminus of the apparatus.

Packer 4 is conventional and purchasable hardware, actuated by work string rotation followed by application of weight, and releasable by reverse rotation and lift on the work string. As shown actuated in FIG. 1B, rubber packers **4*a* are expandable to seal against the well bore wall. Slips 4*b* are pushed out by packer actuation and grip the well casing (WC) wall to provide axial holding ability. There are two fluid flow paths through the packer. Inner tube 1*e* provides bore 1*c*, which completes a channel from the work string bore to bore 5*c* of crossover-release assembly 5. The second channel is an annulus 4*c* outside tube 1*e*** within the packer mandrel. In the runin configuration, the second channel is closed in both axial directions and is ineffective. Some form of drag block (not shown) is usually supplied with the packer to provide a drag resistance on the well bore wall.

In the run-in configuration, flow down the work string bore has continuity, because piston 6 is sealingly situated in the crossover release assembly 5 to close ports **5*d* and ports 6*a* to deliver flow through bore 6*b* to the stinger bore 8*a*. The stinger, or washpipe, 8 is sealingly connected to foot valve 14 by surface 8*b* in bore 14*g* and delivers flow in bore 8*a* to enclosure 14*c* and out openings 14***d*. The flow can go either way. In the run-in configuration, the overall apparatus functions as a single tube to permit forward or reverse circulation to the very bottom of the well.

As shown in FIG. 2*b*, plug 16 can be dropped down the work string bore to enter bore 6*b*, seal against seat 6*e*, and engage undercut 6*f* with snap ring 16*a*. Snap ring 16*a* is in a deep groove in plug 16 and can be pushed below the surface of the plug as it hits tapered seat 6*e* to enter bore 6*b*. The snap ring holds the plug in place. The snap ring, a means to hold the plug in place, may shortly be replaced by a collet having tubular spring fingers tipped with lugs that extend in interference to upward movement of the plug once it moves downward into bore 6*b*.

With plug 16 in place, fluid is pumped down the work string bore to push piston 6 downward to shear bolt 7, open ports 5*d*, and move cylindrical surface 6*d* out from under lugs (or balls) 10, and allow them to move in recess 6*c*. This releases groove 9*b* and the related screen assembly, and nipple 9*c* moves down. Snap ring 6*g* is in a deep groove in piston 6, and when it moves below extension 5*f* the ring snaps out to prevent the upward movement of piston 6.

Once the screen assembly is released, it commonly drops about two feet, the amount determined by positioning the apparatus a selected distance above well bottom before the packer is actuated to seal. The well bottom may be a bridge plug.

When the screen assembly is released and drops, washpipe terminal 8*b* is pulled out of bore 14*g* of the foot valve 14, and the new open end of the stinger washpipe 8 is inside screen 13. The stinger is sealed on the outside by O-ring sub 12.

With washpipe 8 no longer holding the foot valve down and open, spring 15, acting against flange 14*a*, moves the valve element upward. Ports 14*d* are drawn into the bore 14*f* and, hence, closed. Snap ring 14*h* expands once above bore 14*f* and avoids re-opening of the foot valve. Flange 14*e* stops upward motion of the valve movable element.

When assembling the apparatus at the rig floor, the foot valve may serve best if the removal of the washpipe from the foot valve is a reversible process. A simple toggle latch responsive to the washpipe presence to retract from an interfering position is now in use experimentally to replace the one-time action of the snap ring. The same purpose is served once the washpipe is moved upward after screen release downhole.

Cross-over and screen release are one time actions and not directly reversible. In the operational configuration of FIGS. 1B and 2B, there are still two significant actuation options. Arbors 1 and housing 2 are held together by lug 2*a* and groove 1*f*. As will be shown in FIG. 3, groove 1*f* allows lug 2*a* to move peripherally around arbor 1, provided it is moved axially at selected times. In application, arbor 1 is rotated by the work string, and if the work string is not moved axially, lug 2*a* will force sympathetic rotation of housing 2.

If housing 2 is rotated, the packer will be actuated if the packer is in a cased well bore, because slips 4*b* or drag blocks (not shown) always cause some wall drag, and the arbor 4*e* will rotate relative to the slips. The preferred off-the-shelf packer will, in time, seat and resist further work string rotation after weight is applied.

With the packer set, the work string can be lowered against the packer to slide the arbor relative to the housing to align ports 1*d* and 2*c*. This is a valving action, as will be later described.

Figure 3:
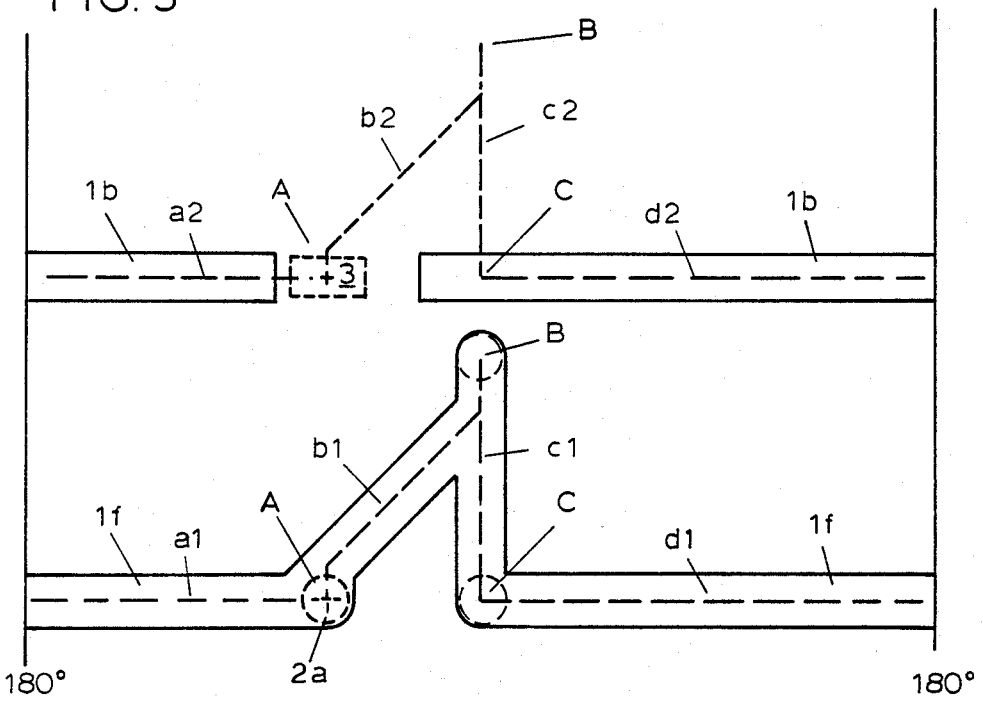
FIG. 3 is a surface development of a selected area of the embodiment of FIGS. 1A and 1B.

FIG. 3 should be addressed in conjunction with FIGS. 1A and 1B. This is a surface development of grooves 1*b* and 1*f* in the cylindrical surface of arbor 2 viewed toward the apparatus centerline. Lug 2*a* is dotted in at position A and is trapped in groove 1*f*. The grooves 1*f* and 1*b* are on arbor 1 and, hence, are responsive to work string movement. Stress key 3 is biased radially inward from close-fitting pocket 2*b* and, hence, like lug 2*a*, can force movement of housing 2.

If the lug 2*a* is in position A, forward work string rotation can drive the lug left to rotate the packer arbor. If the work string is forced downward, lug 2*a* will tend to move along dashed line b1. Key 3, now clear of groove 1*b*, will slide along dashed line b2, provided the work string is rotated clockwise. When lug 2*a* reaches point B, the valve ports 1*d* and 2*c* are aligned and open. The work string can rotate the packer mandrel in either direction at position B.

From position B, the work string can be pulled upward Ito close the port 1*d*-2*c* valve, and from position c, the lug 2*a* can only move right in groove 1*f*, along dashed line d1, around to dashed line a1. Lug 2*a* cannot move from position C to position B, because key 3 will drop into groove 1*b* at position C to prohibit relative axial motion between arbor 1 and housing 2 until the workstring is rotated clockwise until key 3 is again at position A, in the discontinuity of groove 1*b*.

Note that the lug end groove arrangement permits the packer to be "set" or released whether the circulating valve (ports 1*d* and 2*c*) is opened or closed either before or after the gravel screen is released and fluid channel crossover is accomplished.

Figure 4B:
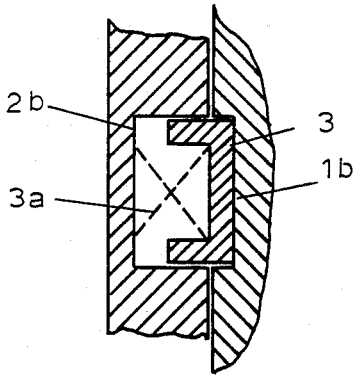
FIGS. 4A and 4B are side views in cutaway of a selected area, rather enlarged, of the embodiment of FIGS. 1A and 1B.
Figure 4A:
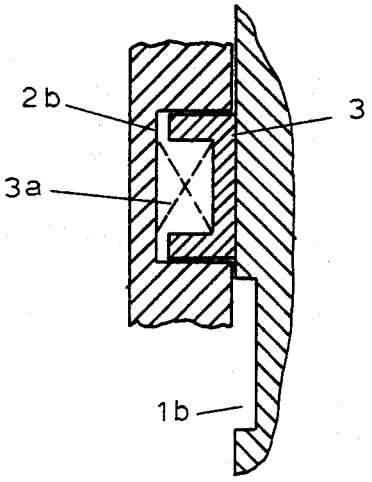

FIGS. 4A and 4B show a side view of key 3 and the related pocket 2*b* and groove 1*b*. Spring 3*a* is a compression spring. The groove 1*b* extends as shown in FIG. 4B almost completely around arbor 1. Near the peripheral position A of FIG. 3, the groove shallows out to a cylindrical surface, and key 3 can move vertically until the work string moves down enough to drop key 3 into groove 1*b*, the arbor 1 can move within limits imposed by lug 2*a* in groove 1*f* (of FIG. 3). The function of key 3 is to prevent return of lug 2*a* from position C to position B until the work string is rotated around to put lug 2*a* in position A. Key 3 also carries most of the axial load on large surfaces to protect the necessarily small lug 2*a*.

Once the screen assembly has been released, the packer can be unseated from the well bore wall by rotating the work string counterclockwise and lifting the load off the packer. The work string can then be moved upward until the lower end of stringer washpipe 8 has been moved above O-ring sub 12. The fluid communication to bore 8*a* then includes both screens 11 and 13. The stinger is still sealed against nipple 9. The packer is reset in this position by clockwise rotation of the work string and application of weight.

When operations yet to be described are complete, the packer is unseated by counterclockwise rotation and lifting of the work string, and the work string is removed from the well. This leaves the entire screen assembly in the well but recovers the stinger 8 and all elements above the stinger.

Having described the mechanical functions of the various features of the apparatus, operational matters can now be more effectively described.

In the run-in configuration of FIGS. 1A and 2A, the apparatus is usable to reverse out jell pills in the well from previous operations. Sand fill found in the well can be reversed to clean up the well bore to the bottom or bridge plug.

In the run-in configuration, the packer can be set, and surge valves up hole in the work string can be actuated This is old art involving the collapse of an air column trapped up hole in the work string to flow shock the formation.

With the packer set and the foot valve well above the perforations, a sand or gravel prepack can be run in the well and into the formation with fluid rising in the well annulus. After prepack is complete, sand settles out in the annulus and is reversed out, totally cleaning up the well bore. The packer can be set at will by clockwise rotation and downthrust, and various flow test and sequence operations can be performed. The order of such squeeze, flow, and prepack operations vary with circumstance but depend upon the tool utility for choices made by operators.

Crossover and screen release actuation is not a directly reversible process and is often preceded by various tests in the run-in configuration. Crossover and screen release can be done at any time by dropping plug 16 down the work string bore and applying fluid pressure to the work string. Common practice, however, will involve positioning the foot valve 14 about two feet above hole bottom and setting the packer before release of screens.

After plug 16 is in place, packer set, and screens released, the well annulus is divided into upper annulus above the packers and lower annulus below the packer. Fluid communication from the upper annulus goes through the circulation valve (ports 1*d* and 2*c*) when open, bore 1*c*, tubular annulus 2*d*, 4*c*, and 5*b*, veins 5*e*, ports 6*a*, bores 6*b* and 8*a*, and the inside of screen 13.

The work string bore will be communicated to the lower well bore annulus by bores 1*c* and 5*c* and ports 5*d*.

Gravel packing involves the injection of a gravel slurry into the work string bore at the earth surface to flow into the lower well annulus, into perforations shown adjacent screen 11, and into the formation. The formation is usually preconditioned to accept gravel, if not already prepacked.

With gravel packing underway, the carrier fluids may be accepted by the well formation or may be allowed to move above the packer from inside screen 13 with the circulating valve open.

If the formation accepts fluids too readily, the circulating valve may be closed to permit the work string bore to limit the rate of fluid delivery to the formation. In case the formation being treated requires high pressure, the circulating valve can be closed to prevent the high pressure standing on the upper well annulus of any reason, such as protection of higher perforations in the well.

When gravel covers the screen 13, flow to bore 8*a* and the upper well annulus will show more resistance, and the operator will know, from pressure gages, where the gravel level has evolved.

By unseating the packer and lifting the work string, stinger 8 can be moved up until the bore 8*a* is opening inside screen 11. The packer is commonly reset and gravel packing continued until screen 11 shows increased flow resistance. Additional gravel is commonly added in known amounts to fill the well annulus around the blank pipe between screen 11 and nipple 9.

With gravel packing completed, the work string is recovered with the downhole assembly minus the screen assembly as previously described.

Figure 5A:
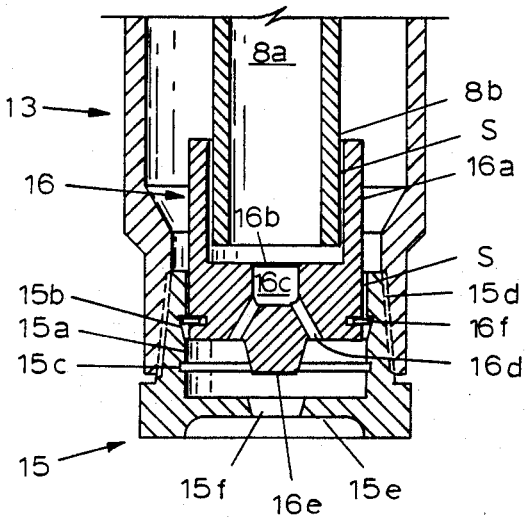
FIGS. 5A and 5B are side views, in cutaway, somewhat enlarged, of an alternate foot valve configuration for the general embodiment of FIG. 1b. Before and after actuation conditions are shown.
Figure 5B:
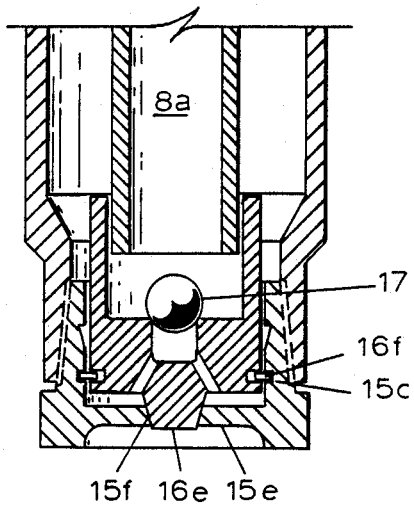

FIGS. 5A and 5B represent an alternate embodiment of the foot valve 14 of FIGS. 2A and 2B. This valve permits actuation before screen release and permits pressure testing the foot valve after closure.

When fluid is pumped down the work string bore and through the washpipe bore 8*a* it flows into recess 16*c*, through openings 16*d*, into the opening 15*a*, and out valve seat 15*f*. Reverse circulation is, of course, carried out in the opposite direction.

Before the crossover release plug 16 is dropped down the work string bore, ball 17 is dropped and goes all the way down to seat 16*b*. When fluid pressure is added to the work string bore, snap ring 16*f* is pushed out of tapered groove 15*b* as plug 16 is moved downward to push poppet 16*e* into seat 15*f*. Snap ring 16*f* expands into groove 15*c* to hold the plug down. Plate 15*e* deforms downward under force to provide resilience to the sealing system even if plug 16 moves slightly upward due to clearance of snap ring and groove.

When the screen 13 is dropped, washpipe extension 8*b* is pulled upward out of the bore of plug 16, as was the case with foot valve configuration 14. The foot valve is sealed permanently.

Figure 6A:
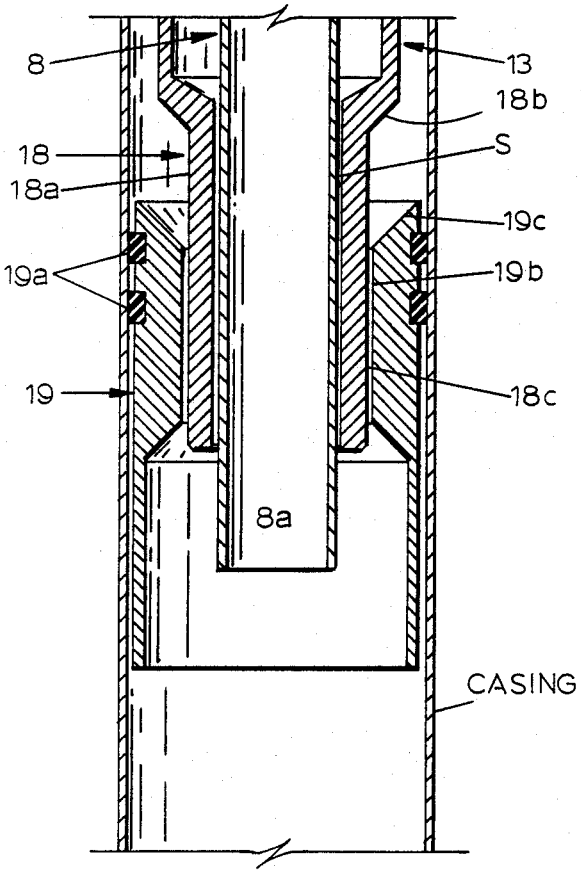
FIGS. 6A and 6B are side views, in cutaway, of an alternate configuration of the invention for use in wells with sump packers installed.
Figure 6B:
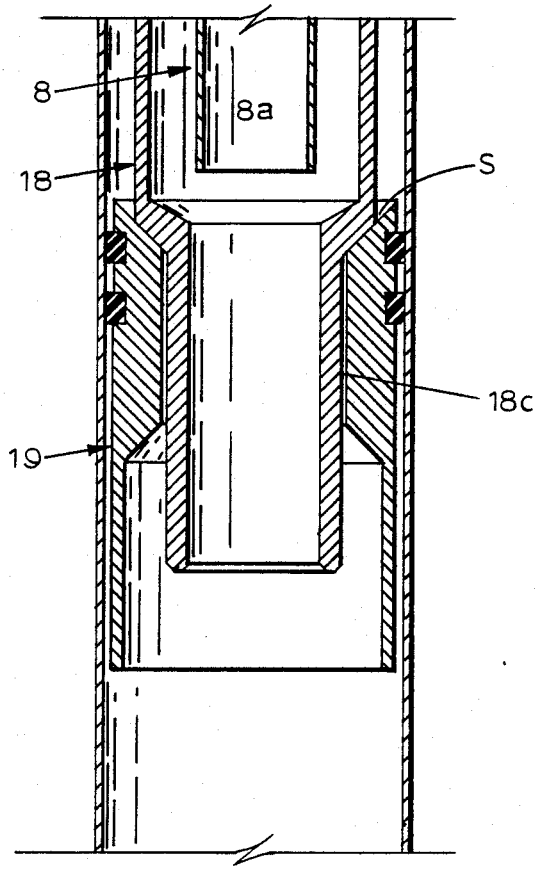

FIGS. 6A and 6B show a modified apparatus for use with wells fitted with sump packers. A sump packer is sealed against well casing and provides hole below to act as a collection sump for fines that enter the screens.

Element 18 may be regarded as a combination O-ring sub to slidingly seal against washpipe 8 and a locator sub to spear into the bore of the sump packer 19. Extension 18*c* does not seal against the bore 19*b* of the sump packer, and fluid can be pumped down the well annulus through the clearance between extension 18*c* and bore 19*b* to clean out the sump and reverse out fines through bore 8*a* of washpipe 8.

When the screen assembly is released, or lowered by any process, seals 18*b* and 19*c* the screen assembly to the sump packer. The seal may be on an enlarged section of extension 18*c* instead but is still sealed to the packer in the lowered position.

To circulate through the screen 13, the washpipe is lifted upward, by repositioning the work string, to clear bore 19*b*.

The screen assembly is left in the well, and the attached elements of 18 continue to seal the screen to the packer. Fines entering the screens may fall below to the sump to extend the working life of the well completion function.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, we claim:

1. Apparatus for use on the lower end of a pipe string suspended in a well, release a gravel screen assembly, treat and gravel pack a well, the apparatus comprising:

(a) a circulation control valve assembly with means to secure to the upwardly continuing pipe string and lower attachment means to secure to a packer;

(b) a packer secured to the lower end of said circulation control valve assembly;

(c) a crossover/release assembly secured to the lower end of said packer, having means to releasably secure to a gravel screen assembly;

(d) a gravel screen assembly releasably secured to said crossover/release assembly;

(e) first valve means, open until actuated to close, situated at the lower end of said gravel screen assembly;

(f) first fluid communication means, extending from said pipe string to and through said first valve means, arranged to be closed by an object delivered down the bore of said pipe string to said crossover/release assembly;

(g) second fluid communication means, closed until actuated to open, extending from the well bore outside and circulation control valve assembly to an opening inside said said gravel screen assembly after release of said gravel screen assembly;

(h) third fluid communication means, closed until actuated to open, extending from the bore of said pipe string to the well through an opening in the side of said crossover/release assembly;

(i) actuator means situated in said crossover/release assembly, responsive to closure of said first communication means and fluid pressure in the bore of said pipe string, to release said gravel screen assembly from said crossover/release assembly and to open said first and said second fluid communication means in a single actuation;

(j) second valve means situtated in said circulation control valve assembly, arranged to close said second fluid communication means in response to one direction of axial movement of said pipe string relative to said packer and to open said second fluid communication means in response to axial movement of said pipe string, in the opposite direction, relative to said packer.

2. The apparatus of claim 1 in which said actuator means comprises a tubular valve element slidably situated in said crossover/release assembly, said tubular valve element arranged to sealingly receive said object transported down the pipe string bore to occlude said first fluid communication means and to provide a piston area to make said tubular valve element move in response to fluid pressure applied to the pipe string bore.

3. The apparatus of claim 2 having lock down means operatively associated with said tubular valve element arranged to lock said tubular valve element in position after moving in response to fluid pressure applied to the work string flow bore.

4. The apparatus of claim 2 having locking means operatively associated with said tubular valve element to lock said object in place once said object has occluded said first fluid communication means.

5. The apparatus of claim 1 in which said second valve means is arranged to permit said fluid communication means to be opened only in response to simultaneous clockwise rotation and downward movement of the pipe string relative to said packer.

6. The apparatus of claim 5 further providing that said second valve means include a cooperating pair of elements one of which is structurely associated with the work string, the other structurally associated with said packer, said cooperating pair of elements having relative motion possibilities limited by a lug on one of said pair constrained for movement within a groove on the other of said pair.

7. The apparatus of claim 6 further provided with one-way relative motion restrictor means operatively associated with said cooperating pair of elements situated to prevent relative motion reversal for at least part of the path of said lug along said groove.

8. The apparatus of claim 1 further providing a small object actuator means operatively associated with said foot valve responsive to an object transported down the work string bore small enough to pass through said crossover-release assembly to close said foot valve in response to fluid pressure applied to said first fluid communication means.

9. The apparatus of claim 8 further providing foot valve lock means operatively associated with said foot valve and responsive to the closing of said foot valve to prevent subsequent opening of said foot valve.

10. The apparatus of claim 1 further providing that said gravel screen assembly comprise an upper and lower screen separated by a sealing sub operatively associated with a washpipe extending from said crossover/release assembly to sealingly slide along said washpipe and to permit withdrawal of said washpipe from said sealing sub to cause the interrior of both said screens to be part of said second fluid communication means.

11. The apparatus of claim 10 further provided that said crossover-release assembly include fluid flow galleries in the wall in fluid communication with the flow bore of said washpipe comprise at least part of said second fluid communication means.

12. The apparatus of claim 11 further providing that said crossover-release assembly include a generally central bore in fluid communication with said washpipe bore and generally transverse fluid communication means extending from said generally central bore to the outside of said crossover-release assembly.

13. The apparatus of claim 12 further provided with a sleeve sealingly and slidably associated with said generally central bore situated to move between a first position and a second position, said sleeve to occlude said transverse fluid communication means and said fluid communication means between said galleries and said washpipe bore in said first position.

14. The apparatus of claim 13 further providing that said sleeve open said transverse communication means and said communication means between said galleries and said washpipe bore in said second position.

15. The apparatus of claim 1 wherein said gravel screen assembly telescopingly receive part of said crossover-release assembly for sealingly slidable association therewith, said slidable association inhibited by interfering machine elements, said machine elements responsive to movement of a sleeve slidably situated in said crossover-release assembly to move out of interference to permit said gravel screen assembly to slide from said crossover-release assembly.

16. The apparatus of claim 15 wherein said sleeve is operatively associated with said actuator means.

17. The apparatus of claim 15 wherein that said sleeve is at least part of said actuator means.

18. An improved gravel packing assembly for use on a working pipe string suspended in a well, the assembly including, in downward series, a pipe string, a circulation control valve sub-assembly, a packer, a crossover/-release sub-assembly and a gravel screen sub-assembly releasably secured to said crossover/release sub-assembly, the improvement comprising:

(a) first fluid communication means extending from the bore of said pipe string to an opening below said gravel screen sub-assembly, said first fluid communication means arranged to be closed by an object delivered down the bore of said pipe string to said crossover/release sub-assembly;

(b) second fluid communication means, closed until actuated to open, extending from the well bore above said packer to an opening inside said gravel screen sub-assembly;

(c) third fluid communication means, closed until activated to open, extending from the bore of said pipe string to an opening to the well bore below said packer;

(d) actuator means situated in said crossover/release sub-assembly, responsive to closure of said first fluid communication means and fluid pressure in said pipe string, to release said gravel screen sub-assembly and open said second and said third fluid communication means;

(e) first valve means situated in said circulation control valve sub-assembly, arranged to close said second fluid communication means in response to axial movement of said pipe string in one direction relative to said packer and to open said second fluid communication means in response to axial movement, in the opposite direction relative to said packer; and (f) foot valve means, fluidly connected to said first fluid communication means and open to the well bore and arranged to be closed and disconnected from said first fluid communication means by release of said gravel screen sub-assembly.

19. Apparatus for use, attached to the lower end of a pipe string suspended in a well, to treat and gravel pack a well fitted with a sump packer, the apparatus comprising:

(a) a circulation control valve assembly secured to the lower end of the pipe string;

(b) a packer secured to the lower end of said circulation control valve assembly;

(c) a crossover/release assembly secured to the lower end of said packer;

(d) a gravel screen assembly releasably secured to the lower end of said crossover/release assembly;

(e) a sump packer stinger extending from said crossover/release assembly, through the lower extreme of said gravel screen assembly and some distance below said gravel screen assembly;

(f) first fluid communication means extending from the bore of said pipe string to the lower end of said sump packer stinger, said first fluid communication means arranged to be closed by an object delivered down the bore of said pipe string to said crossover/release assembly;

(g) second fluid communication means, closed until actuated to open, extending from the well bore at an opening outside said control valve assembly to the lower end of said pump packer stinger when said pump packer stinger is lifted after release of said gravel screen assembly to open inside said gravel screen assembly;

(h) third fluid communication means, closed until actuated to open, extending from the bore of said pipe string to an opening to the well bore on the outside of said crossover/release assembly;

(i) actuator means situated in said crossover/release assembly, responsive to the closure of said first fluid communication means and fluid pressure in said pipe string, to release said gravel screen assembly and to open said second and said third fluid communication means;

(j) valve means situated in said circulation control valve assembly, arranged to close said second fluid communication means in response to axial movement of said pipe string in one direction relative to said packer and to open said second fluid communication means in response to axial movement of said pipe string in the other direction relative to said packer;

(k) a locator sub forming the lower terminal of said gravel screen assembly and having a projection to slidingly engage a sump packer in the well, and a bore arranged to slidingly accept said pump packer stinger.

20. The apparatus of claim 19 further providing means to seal with fluid tightness said locator sub and a sump packer bore in a treated well when said locator sub is in the most downward position relative to said sump packer.

21. The apparatus of claim 19 further providing that a washpipe extend from said crossover-release assembly downward through said screen assembly to telescopingly and sealingly slide through a bore in said locator sub.

* * * * *